United States Patent [19]

Caskey et al.

[11] 4,362,638

[45] Dec. 7, 1982

[54] GELLED LAUNDRY PRE-SPOTTER

[75] Inventors: Michele M. Caskey; John A. Sramek, both of Racine, Wis.

[73] Assignee: S. C. Johnson & Son, Inc., Racine, Wis.

[21] Appl. No.: 299,457

[22] Filed: Sep. 4, 1981

Related U.S. Application Data

[63] Continuation-in-part of Ser. No. 172,613, Jul. 28, 1980, abandoned.

[51] Int. Cl.[3] ..... C11D 1/70; C11D 1/825; C11D 3/44; C11D 17/00

[52] U.S. Cl. ..... 252/90; 8/137; 8/139.1; 252/162; 252/170; 252/173; 252/174.21; 252/174.22

[58] Field of Search ..... 252/90, 162, 170, 173, 252/174.21, 174.22; 8/137, 139.1

[56] References Cited

U.S. PATENT DOCUMENTS

| | | | |
|---|---|---|---|
| Re. 29,649 | 5/1978 | Farnsworth | 252/171 |
| 3,553,130 | 1/1971 | Stratton | 252/8.55 |
| 3,625,909 | 12/1971 | Berg | 252/153 |
| 3,707,506 | 12/1972 | Lozo | 252/139 |
| 3,849,347 | 11/1974 | Tokiwa | 252/545 |
| 3,929,680 | 12/1975 | Arai | 252/542 |
| 3,948,819 | 4/1976 | Wilde | 252/545 |
| 3,983,078 | 9/1976 | Collins | 252/540 |
| 3,985,670 | 10/1976 | Berg | 252/117 |
| 4,124,542 | 11/1978 | Devine | 252/546 |
| 4,176,080 | 11/1979 | Wise | 252/162 |
| 4,178,262 | 12/1979 | Compton | 252/162 |
| 4,180,472 | 12/1979 | Mitchell | 252/162 |
| 4,289,644 | 9/1981 | Steinhauer | 252/122 |

FOREIGN PATENT DOCUMENTS

| | | | |
|---|---|---|---|
| 698560 | 11/1964 | Canada | 252/139 |
| 2529080 | 1/1977 | Fed. Rep. of Germany | 252/174.22 |

*Primary Examiner*—Dennis L. Albrecht

[57] ABSTRACT

A mobile gel laundry pre-spotting composition including approximately equal amounts of a nonyl phenol having 8 moles of ethylene oxide and a nonyl phenol having 6 moles of ethylene oxide in combination with an isoparaffinic hydrocarbon solvent, d-Limonene, n-butoxy propanol and water. The composition may also be dispensed from an aerosol container.

3 Claims, No Drawings

GELLED LAUNDRY PRE-SPOTTER

This application is a continuation-in-part of our copending application Ser. No. 172,613 filed July 28, 1980, now abandoned.

BACKGROUND OF THE INVENTION

This invention relates to a solvent and water-containing pre-spotter composition. More particularly this composition relates to a solvent-water pre-spotter composition in gel form.

Pre-spotters for use in aiding the removal of difficult stains and soils have been known for a long time. By and large the bulk of these pre-spotters are either solvent-based or aqueous-based. Aqueous-based pre-spotters work especially well on aqueous-based stains such as food stains, etc., while solvent-based pre-spotters work best on oily stains such as greases, oily dirts and the like. Although prior art pre-spotters do aid in the removal of all stains because of the emulsifiers and surfactants present, their activity on certain stains has not been completely effective.

It has, therefore, been desired that a single pre-spotting combination can be prepared which will have high stain removal activity both for aqueous-based stains and oil-based stains. This composition also must be stable so that it may be stored for extended periods of time.

BRIEF DESCRIPTION OF THE INVENTION

It has now been found that a particular combination of nonionic surfactants in combination with certain solvents and a certain percentage of water can be formed into a stable gel-like composition. This composition can either be utilized as is as a pre-spotter or can be pressurized in an aerosol container. This composition contains from 13 to 17% by weight of ethoxylated nonyl phenol having 8 moles of ethylene oxide, 13 to 17% by weight of an ethoxylated nonyl phenol having 6 moles of ethylene oxide, from 20 to 28% by weight of an isoparaffinic hydrocarbon solvent, from 8 to 12% by weight d-limonene, from 4 to 6% by weight n-butoxy propanol, and 25 to 35% by weight water. This composition can be pressurized utilizing from 5 to 20% by weight of hydrocarbon propellents.

OBJECTS AND ADVANTAGES

It is, therefore, the primary object of the present invention to provide a stable pre-spotting composition which has good activity against both oily and aqueous-based stains.

It is a further object of the present invention to provide a stable universal pre-spotter composition which can be easily and quickly applied to fabrics prior to laundry.

Still further objects and advantages of the composition of the present invention will become more apparent from the following more detailed description thereof.

DETAILED DESCRIPTION OF THE INVENTION

The laundry pre-spotting composition of the present invention comprises from about 13–17% by weight ethoxylated nonyl phenol having 8 moles of ethylene oxide; from about 13–17% by weight ethoxylated nonyl phenol having 6 moles of ethylene oxide; from about 22–28% by weight of an isoparaffinic hydrocarbon solvent; from about 8–12% by weight of d-limonene; from about 4–6% by weight of n-butoxy propanol; and from about 25–35% by weight of water. When this composition is dispensed from an aerosol container the above composition is utilized as an intermediate and is combined with from 5–20% by weight of a hydrocarbon propellent selected from propane, butane and isobutane or mixtures thereof.

The laundry pre-spotting composition of the present invention contains two nonionic surfactants, an ethoxylated nonyl phenol having 8 moles of ethylene oxide and an ethoxylated nonyl phenol having 6 moles of ethylene oxide. These two nonionic surfactants are chosen because of their relative HLBs and the fact that the composite HLB is approximately 11.7 when equal parts of these surfactants are used. Single nonionic surfactants having an HLB of 11.7, however, such as ethoxylated nonyl phenols having 7 moles of ethylene oxide do not perform as satisfactorily and, in fact, do not form a stable composition. It is thought that the nonyl phenol with 6 moles of ethylene oxide acts to keep the solvents in the composition while the nonyl phenol with 8 moles of ethylene oxide acts to keep the water within the composition to form a mobile gel. It is preferred that the two nonionic surfactants be present in approximately a 1:1 ratio.

Although the nonionic surfactants will be referred to as having a specific number of moles of ethylene oxide commercial nonionic surfactants such as those utilized in the composition of the present invention actually are compositions having an average ethylene oxide content as listed. Therefore the nonyl phenol having 8 moles of ethylene oxide actually does contain small percentages of other nonyl phenols with various other amounts of ethylene oxide. Similarly the nonyl phenol with 6 moles of ethylene oxide contains materials other than the stated material.

In addition to the stabilizing function of the above surfactants, these surfactants also have a strong effect on the cleaning properties of the composition in the present invention. Both these surfactants are good emulsifiers for oily stains and/or water-based stains.

In order to aid the removal of certain oily-type stains certain solvent materials were also added to the composition. The composition includes from 22–28% by weight of an isoparaffinic hydrocarbon solvent having a boiling range of 97°–206° C. Suitable isoparaffinic hydrocarbon solvents include the Isopar series solvents which are mixtures of $C_{10}$–$C_{12}$ saturated hydrocarbons characterized by various boiling ranges, and, in particular, Isopar L, a mixture of $C_{10}$–$C_{12}$ saturated hydrocarbons having a boiling range of 188°–206° C.

In addition to the isoparaffinic hydrocarbons the composition also includes from about 8–12% by weight of d-limonene. This material is a solvent having high solvency power and greatly adds to the cleaning properties of the composition of the present invention.

The composition also includes from 4–6% by weight of n-butoxy propanol. This material is also a strong cleaning solvent which will not damage fabrics and aids in the removal of tough oily stains.

The composition also includes from 25–35% by weight of water. The water is present in the composition to aid in the removal of water-based stains. The water in combination with the water soluble nonionic surfactant aids in the removal of water-based stains.

As noted above, the composition of the present invention can be utilized either as is or in an aerosol form. When utilized as is the composition forms a relatively thick but mobile gel which can be spread onto the fabric by a variety of means including squeeze tubes, various applicators and the like.

However the preferred method of dispensing the composition of the present invention is to pressurize the same. This composition can be pressurized by taking the above composition and utilizing the same as an intermediate and combining this intermediate with from 5–20% by weight based on the weight of the intermediate of a hydrocarbon propellent selected from propane, butane, isobutane and mixtures thereof. When pressurized in this fashion this composition of the present invention is dispensed as a quick breaking foam which forms a gel on the fabric. At this point the composition can then be rubbed into the stain and allowed to sit for a few minutes prior to washing.

The composition of the present invention can be easily and quickly prepared by combining the various components in the composition. These components can be combined in any order with mixing to form the composition of the present invention. In order to fill the composition into aerosol containers it has been found helpful to heat the intermediate composition to reduce the viscosity during filling. It has been generally found that heating to a temperature of about 35° to 50° C. is sufficient to enable the composition to flow readily and easily into the aerosol containers for pressurization.

The composition of the present invention will now be illustrated by the following examples. These examples are for the purpose of illustration only and are not to be construed in any way as limiting. In the following examples all parts and percentages are by weight and all temperatures are in degrees Celsius.

EXAMPLE 1

The following gel pre-spotter formulation was prepared:

Makon 8 (nonyl phenol plus 8 moles ethylene oxide)—15%
Surfonic N-60 (nonyl phenol plus 6 moles ethylene oxide)—15%
Isopar L (boiling range 188°–206° C.)—25%
d-Limonene—10%
n-butoxy propanol—5%
Triethanolamine (85%)—0.1%
Tap water—29.9%

The above components are mixed and formed a transparent thick mobile gel. This composition when applied on an oily stained 65% cotton-35% polyester shirt followed by washing completed removed the stain. Similarly, when the composition is applied to a water-based stain such as grapejuice, the grapejuice stain was removed after washing, while a similar stain without pretreatment was not completely removed.

EXAMPLE 2

The composition of Example 1 was pressurized by taking the composition of Example 1 as an intermediate and combining 85% of the composition of Example 1 with 15% isobutane. This composition was placed in an aerosol container and when sprayed out onto the fabric formed a quick breaking foam which broke into a gel. After rubbing into the fabric this composition efficiently removes both oil and water-borne stains.

What is claimed is:

1. A laundry pre-spotting composition comprising from about 13–17% by weight of an ethoxylated nonyl phenol having 8 moles of ethylene oxide; from about 13–17% by weight of an ethoxylated nonyl phenol having 6 moles of ethylene oxide; from about 22–28% by weight of an isoparaffinic hydrocarbon solvent having a boiling range of 97°–206° C.; from about 8–12% by weight of d-Limonene; from about 4–6% by weight of n-butoxy propanol; and from about 25–35% by weight of water.

2. The composition of claim 1 wherein the composition is pressurized in an aerosol container utilizing from 5–20% by weight of a hydrocarbon propellent selected from the group consisting of propane, isobutane and butane and mixtures thereof.

3. The composition of claim 1 wherein the isoparaffinic hydrocarbon has a boiling range of 188°–206° C.

* * * * *